US006554636B2

(12) United States Patent
Walker et al.

(10) Patent No.: US 6,554,636 B2
(45) Date of Patent: Apr. 29, 2003

(54) CONNECTOR APPARATUS

(75) Inventors: Simon J. E. Walker, Ulverston (GB); Ian G. Wilkinson, Burton-in-Kendal (GB); Gillian A. McKinnon, Dalton-in-Furness (GB)

(73) Assignee: Tronic Limited, Cumbria (GB)

( * ) Notice: Subject to any disclaimer, the term of this patent is extended or adjusted under 35 U.S.C. 154(b) by 0 days.

(21) Appl. No.: 09/827,589

(22) Filed: Apr. 6, 2001

(65) Prior Publication Data

US 2001/0051456 A1 Dec. 13, 2001

Related U.S. Application Data

(60) Provisional application No. 60/207,608, filed on May 26, 2000.

(30) Foreign Application Priority Data

Apr. 6, 2000 (GB) ..... 0008522

(51) Int. Cl.[7] ..... H01R 13/00
(52) U.S. Cl. ..... 439/484; 403/33; 174/86
(58) Field of Search ..... 439/8, 483, 484, 439/476.1, 477–480, 157, 310, 519, 10, 11, 66, 586–596, 693; 403/33, 119, 121; 174/86, 84 R

(56) References Cited

U.S. PATENT DOCUMENTS 1,065,483 A * 6/1913 Turner ..... 439/8
4,501,511 A * 2/1985 Albert, Jr. ..... 403/24
4,717,351 A 1/1988 McCormick
4,725,238 A * 2/1988 Meyer ..... 439/476
4,732,149 A * 3/1988 Sutter ..... 128/303.13
4,746,297 A * 5/1988 Soleau ..... 439/8
4,786,759 A * 11/1988 Gouverneur ..... 174/70 S
5,454,731 A * 10/1995 Dickie ..... 439/484
5,545,049 A * 8/1996 Hasegawa et al. ..... 9/310
5,567,181 A * 10/1996 Lentz et al. ..... 439/694
5,617,866 A * 4/1997 Marian, Jr. ..... 128/662.3
6,121,550 A * 9/2000 Misaki ..... 174/86
6,128,198 A * 10/2000 Kurrer et al. ..... 361/759
6,196,531 B1 * 2/2002 Ito et al. ..... 439/157

OTHER PUBLICATIONS

Cat. No. ME–7 10M 6/68.*

* cited by examiner

*Primary Examiner*—Tho D. Ta
*Assistant Examiner*—Larisa Tsukerman
(74) *Attorney, Agent, or Firm*—Alix, Yale & Ristas, LLP

(57) ABSTRACT

Apparatus for use at an end of a cable in an underwater or severe environment, comprising a connector part for connection with the cable and adapted to be brought axially into engagement with another connector part, the connector part having a laterally directed fitting for connecting the cable thereto, and the apparatus further comprising a handle secured to the connector part at a location rearwardly of the fitting.

10 Claims, 2 Drawing Sheets

CONNECTOR APPARATUS

This application claims the benefit of Provisional application Ser. No. 60/207,608, filed May 26, 2000.

FIELD OF THE INVENTION

The invention relates to apparatus for use at an end of a cable in an underwater or severe environment and comprising a connector part for connection with the cable, and to a connector for use in an underwater or severe environment.

BACKGROUND OF THE INVENTION

It is known in the offshore oil and gas industry to connect up services at underwater sites such as a well head installed on the sea bed. It is known from GB-A-2 192 316 to provide an underwater electrical connector having a first part provided with a plug which houses a set of electrical contact terminals and a second part provided with a mating socket surrounding a corresponding set of electrical contact pins. The plug has a cylindrical outer surface designed to fit in the socket which is also cylindrical. In use, the second part of the connector is normally secured to a sea bed installation and the first part is mated with the second part by a diver who inserts the plug into the socket, whereby the contact pins make electrical contact with the contact terminals. In some circumstances, for example in deep water, it may be preferred to use a remotely operated vehicle (ROV) rather than a diver to make the connection.

A known apparatus for use at the end of a cable in an underwater or severe environment is disclosed in International patent application No WO92/12554. As described in this application, and shown in FIGS. 16 and 17 thereof, a plug connector part is provided at its rear with a laterally directed fitting through which a cable passes into the interior of the connector part. A handle is provided to the rear of the connector part to be gripped by a diver or ROV in order to carry the plug connector part to an already installed receptacle and make the connection. The mating procedure requires careful manipulation of the plug connector part, often in poor visibility conditions, to try and achieve alignment of the connector parts and thus successful mating. In particular the diver or ROV operator should aim to avoid angular misalignment in the axial direction and circumferential misalignment.

To assist the user in maintaining control of the orientation of the connector part, the known handle is provided with a "U"-shaped yoke which extends forwardly from the grip portion of the handle on either side of the rear housing of the connector part, where the cable fitting is provided, to a position in front of the cable fitting where the yoke attaches to the connector part. The attachment is by means of a support ring welded on opposite sides to the front ends of the "U"-shaped yoke. The support ring engages in an annular groove around the outside of a rubber washer which fits round the outer circumference of the connector part and is held between a pair of axially spaced abutment rings on the connector part.

The known support arrangement works well in that the yoke supports the connector part forwardly of the cable fitting and generally centrally of the connector part, thereby tending to balance the mass of the portion of the connector part in front of the attachment point with the combined masses of the rear of the connector part and the cable leading into the rear of the connector part. Moreover, the rubber washer allows the Connector part to tilt resiliently on the support ring relative to the axial direction by ±10° and also allows relative movement in the circumferential direction, thereby facilitating connection it there is some misalignment.

There is however a problem in the support arrangement in that the yoke, support ring and rubber washer all have to be sized in accordance with the outer diameter of the connector part, so that a universal support arrangement for a range of connector part sizes is not available. This leads to inventory related costs. Further, when assembling the apparatus, because the support arrangement is in front of the cable fitting, it is necessary to mount the connector part on the handle before connecting the cable to the connector part, which is not always convenient because the handle has to be available at the start of the build process.

SUMMARY OF THE INVENTION

Viewed from a first aspect the invention provides apparatus for use at an end of a cable in an underwater or severe environment, comprising a connector part for connection with the cable and adapted to be brought axially into engagement with another connector part, the connector part having a laterally directed fitting for connecting the cable thereto, and the apparatus further comprising a handle secured to the connector part at a location rearwardly of the fitting.

Viewed from a second aspect the invention provides a connector for use in an underwater or severe environment, comprising first and second connector parts adapted to be brought axially into engagement with each other, the first connector part having a laterally directed fitting for connecting a cable thereto, and the connector further comprising a handle secured to the first connector part at a location rearwardly of the fitting.

The handle can be secured to the connector part after connecting the cable, and preferably after complete assembly of the connector part, leading to flexibility during the manufacturing process. The arrangement also avoids dependence of the handle construction on the outer diameter of the connector part and can therefore permit the same handle size to be used for a range of sizes of connector part. The inventors have found that it is possible to secure the handle to the connector part rearwardly of the cable fitting without an unacceptable loss of control of the apparatus during connector engagement.

The apparatus preferably comprises a flexible portion for providing compliance between the handle and the connector part. Thus if there is some misalignment during the engagement of the connector part with the other connector part, successful mating may he achieved without necessarily having to re-orientate the handle. The flexible portion is preferably made from a resilient material, more preferably an elastomeric material, such as rubber, e.g. nitrile rubber or hydrogenated nitrile rubber.

Various securing arrangements may be provided to the rear of the fitting. A rigid securing means may be used, particularly if compliance allowing for misalignment is provided elsewhere in the system. Where a flexible portion is provided, the connector part and the handle may both be securely attached to the flexible portion. It is however preferred to provide a more positive securing arrangement, between rigid components, with the additional use of a flexible portion to resist relative movement of the components. In preferred embodiments, the handle is secured to the connector part by securing means comprising a pin passing through a bearing such that the pin and the bearing are relatively pivotable generally about the axis of the pin, and wherein the flexible portion is arranged to resist such relative pivoting. With such an arrangement of the securing means, the handle can support the connector part cantilevering forwardly therefrom without too much bending, whilst still providing compliance.

Such securing means is believed to be inventive in its own right, and accordingly viewed from another aspect the invention provides apparatus for use at an end of a cable in an underwater or severe environment, comprising a connector part for connection with the cable and adapted to be brought axially into engagement with another connector part, and a handle secured to the connector part by securing means comprising a pin passing through a bearing such that the pin and the bearing are relatively pivotable generally about the axis of the pin, and a flexible portion arranged to resist such relative pivoting.

The pin is preferably arranged perpendicularly to the axis of the connector part. Pivoting about the pin axis then provides for angular misalignment of the connector part and the handle, i.e. tilting relative to the axial direction. Whilst this is beneficial, the pivoting is only in one plane. Preferably, therefore, the passage of the pin through the bearing is also such as to allow relative pivoting of the pin and the bearing generally about an axis perpendicular to the pin axis and to the axis of the connector part. Pivoting is then possible in at least two planes. This may for example be achieved by the pin having a diameter smaller than the diameter of a hole defined by the bearing and through which the pin passes, i.e. a loose fit of the pin in the hole. Such an arrangement can in fact allow for angular misalignment in any lateral direction, i.e. left, right, up, down or any intermediate misalignment between these.

Further compliance is preferably provided by the passage of the pin through the bearing being such as to allow relative pivoting of the pin and the bearing generally about the axis of the connector part. This can allow for rotational misalignment. Again, where the pin is arranged perpendicularly to the axis of the connector part, this may be achieved by a loose fit of the pin in a bearing hole.

The passage of the pin through the bearing may also be such as to allow relative axial movement of the pin and the bearing. The preferred arrangement of the pin fitting loosely in a bearing hole can permit such axial movement. Axial compliance is advantageous to absorb initial shock loads as the connector parts are brought together.

The various relative movements discussed above are advantageously resisted by the flexible portion, preferably in resilient manner. In a preferred arrangement, the pin is mounted by a pin support and the flexible portion is interposed between an abutment fixed in relation to the pin support and an abutment fixed in relation to the bearing.

The pin may be provided on the handle and the bearing on the connector part, but preferably the pin is provided on the connector part and the bearing is provided on the handle. This can simplify the construction of the handle, which is preferably a single casting.

It is preferred for the flexible portion to be located rearwardly of the pin.

BRIEF DESCRIPTION OF THE DRAWINGS

A preferred embodiment of the invention will now be described by way of example and with reference to the accompanying drawings, in which.

DESCRIPTION OF THE PREFERRED EMBODIMENTS

Figure 1:
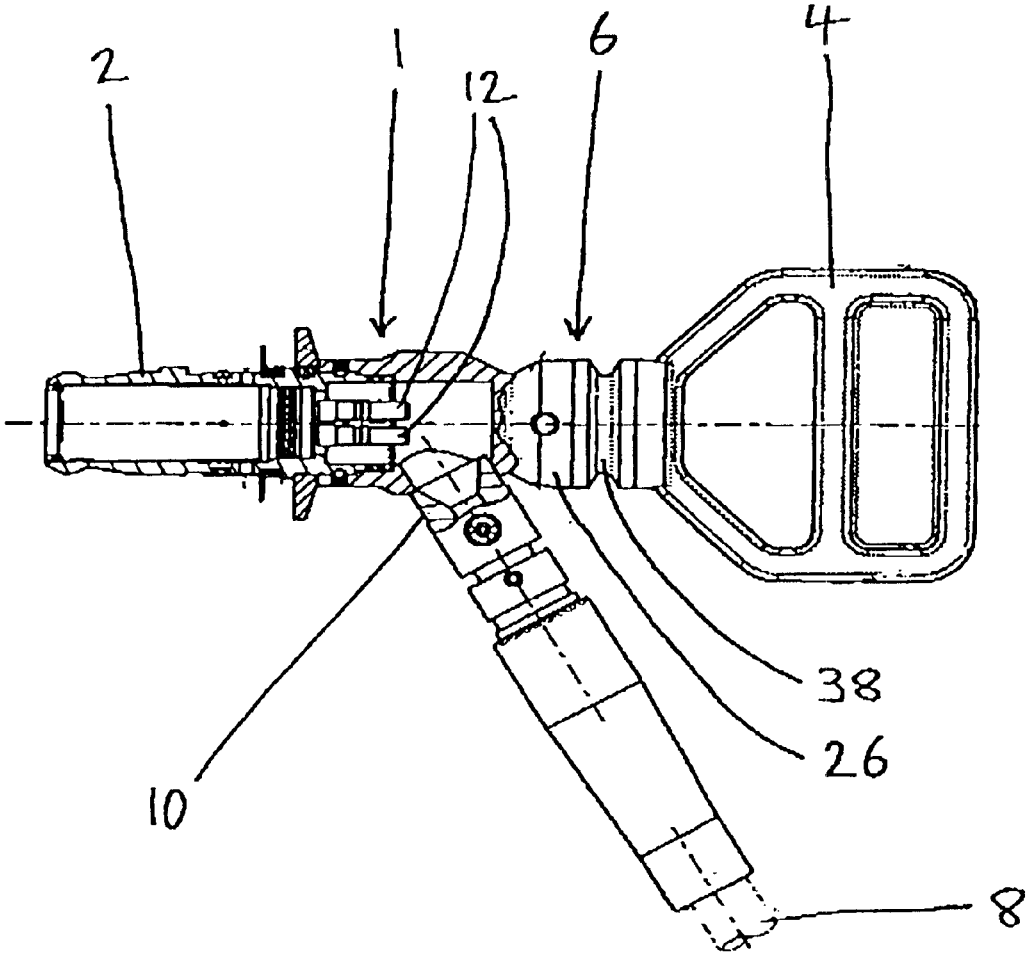
FIG. 1 shows a partly sectioned side view of a connector part, handle and cable hose.

The connector part 1 has at its front end a plug 2 which is adapted to be interengaged with a receptacle of another connector part (not shown) to establish a connection, for example an electrical or optical connection. A handle 4 is secured to the rear of the connector part 1 by securing means 6. A cable conduit hose 8 is attached to a fitting 10 provided on a side wall of the connector part 1 at a location forwardly of the handle securing means 6. Although not shown, there would normally be cables, such as electrical and/or optical cables, extending along the hose 8 and into the connector part 1 to form a connection with the terminals 12 inside the connector part.

Figure 2:
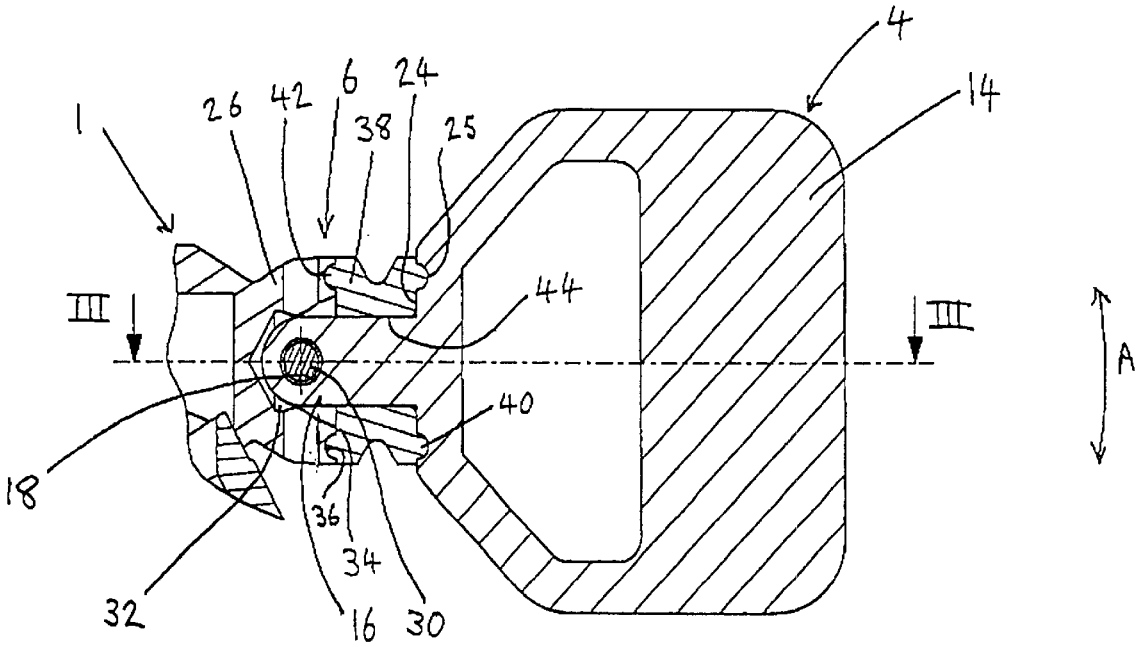
FIG. 2 shows a longitudinal section through the handle and the means for securing the connector part and handle together.
Figure 3:
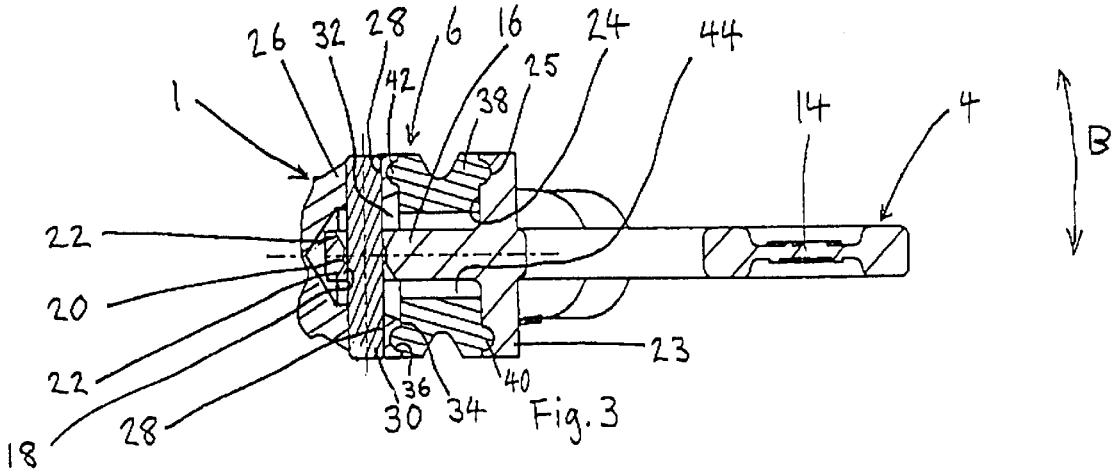
FIG. 3 shows a section on the lines III—III of FIG. 2.

Further details of the way in which the handle 4 is secured to the connector part by the securing means 6 are shown in FIGS. 2 and 3. The handle 4 is provided at its rear with a grip plate 14 and at its front with a bearing 16. The bearing comprises a bearing hole 18 which, as shown in FIG. 3 has a waisted or hour-glass shape. The hole 18 therefore has a central cylindrical portion 20 and on each side thereof a frusto-conical portion 22. Disposed at an intermediate position on the handle 4 a lateral flange 23 having a forwardly facing abutment surface 24 is provided, the general plane of the abutment surface being parallel to the axis of the hole 18. An annular recess 25 is defined in the abutment surface 24.

The connector part 1 has a pin support portion 26 which defines a pair of laterally spaced cylindrical bores 28 which receive a laterally extending pin 30. The pin spans across a cavity 32 defined by the pin support 26 and passes through the hole 18 defined by the handle bearing 16. The pin 30 has a diameter smaller than that of the central cylindrical portion 20 of the hole 18.

The pin support 26 has a rearwardly facing abutment surface 34 in which is defined an annular recess 36. The general plane of the abutment surface 34 is perpendicular to the axis of the connector part 1.

A flexible portion in the form of an elastomeric, e.g. nitrile or hydrogenated nitrile rubber, bush 38 is disposed axially between the abutment surface 24 of the handle 4 and the abutment surface 34 of the pin support portion 26. The bush 38 is provided with opposed annular projections 40,42 which respectively fit in the annular recesses 25,36 of the abutment surfaces 24,34. The bush has a central portion of reduced diameter to increase its flexibility. The bush 38 has an axially extending passage 44 through which the handle 4 extends.

When it is desired to mate the plug 2 of the connector part 1 in a receptacle of another connector part, the handle 4 is gripped by an ROV or diver and carried to the connection site. The user will attempt to align the connector part axially and rotationally with the other connector part, but since absolute alignment is difficult to achieve it is desirable to provide some compliance between the handle 4 and the connector part 1. Such compliance is provided by the compliant securing means 6. The handle 4 may pivot about the axis of the pin 30, so as to move relative to the connector part as shown by arrow A in FIG. 2 Such pivotal movement is permitted by the size of the cavity 32 in the pin support portion 26 relative to the size of the bearing 16 of the handle 4. The pivotal movement is resiliently resisted by the bush 38 disposed between the abutment surfaces 34, 38.

The handle 4 may also pivot relative to the connector part 1 about an axis perpendicular to the pin axis and perpendicular to the connector part axis, so as to move as shown by arrow B in FIG. 3. Such pivotal movement is permitted by the central cylindrical portion 20 of the hole 18 being oversized relative to the diameter of the pin 30 and by the frusto-conical portions 22 of the hole 18. The cavity 32 also allows space for the bearing 16 to move within it. The pivotal movement is again resiliently resisted by the bush 38 disposed between the abutment surfaces 34,38.

If there is rotational misalignment, relative rotational movement of the handle 4 and connector part 1 is permitted. Again, this is allowed because of the loose fit of the pin 30 in the hole 18. Such rotational movement is resisted by torsion of the bush 38.

Lastly, the arrangement of the securing means 6 permits relative axial movement between the handle 4 and the connector part 1. This is allowed by the oversizing of the cylindrical portion 20 of the hole 18 relative to the pin 30.

In the preferred embodiment, the relative movement of the handle and the connector part is ±20° angular movement, ±20° rotational movement and ±1 mm axial movement. There is thus an improved range of relative movement, i.e. compliance, allowed, whilst the securing means is stiff enough not to bend too easily.

It will be appreciated that in the described embodiment, a receptacle connector part is described as being provided at a seabed installation, with a plug connector part being carried by an ROV or diver to the installation to make the connection, However, the reverse arrangement of the plug connector part being already installed and the receptacle connector part being transported to the connection site may be preferred in some applications.

In addition, the invention in its different aspects is not limited to the features of the preferred embodiment described above and many modifications could be made to these embodiments which would be within the scope of the invention as claimed.

What is claimed is:

1. Apparatus for use at an end of a cable in a subsea environment, comprising:

a connector part for connection with the cable, said connector part being adapted to be brought axially into engagement with another connector part and comprising a laterally directed fining for connecting the cable thereto;

a handle secured to the connector part at a location rearwardly of the fitting, said handle comprising a bearing, wherein said handle is secured to said connector part by a pin passing through the bearing such that the bearing is pivotable generally about the axis of the pin; and a flexible portion arranged to resist the pivoting of the bearing about the axis of the pin, wherein said flexible portion provides compliance between the handle and the connector part.

2. Apparatus as claimed in claim 1, wherein the passage of the pin through the bearing is such as to allow relative pivoting of the pin and the bearing generally about an axis perpendicular to the pin axis and to the axis of the connector part.

3. Apparatus as claimed in claim 1, in combination with said other connector part.

4. Apparatus for use at an end of a cable in an underwater or severe environment, comprising:

a connector part for connection with the cable, said connector part being adapted to be brought axially into engagement with another connector part and comprising a laterally directed fitting for connecting the cable thereto;

a handle secured to the connector part at a location rearwardly of the fitting, said handle comprising a bearing, wherein said handle is secured to said connector part by securing means comprising a pin passing through the bearing such that the bearing is pivotable relative to the pin generally about the axis of the pin; and a flexible portion for providing compliance between the handle and the connector part, the flexible portion being arranged to resist the pivoting of the bearing relative to the pin, wherein the bearing is configured to allow pivoting of the pin relative to the bearing generally about an axis perpendicular to the pin axis and to the axis of the connector part.

5. Apparatus as claimed in claim 4, wherein the pin is provided on the connector part and the bearing is provided on the handle.

6. Apparatus for use at an end of a cable in an underwater or severe environment, comprising:

a connector part for connection with the cable, said connector part being adapted to be brought axially into engagement with another connector part and comprising a laterally directed fitting for connecting the cable thereto;

a handle secured to the connector pan at a location rearwardly of the fitting, wherein said handle is secured to said connector part by a pin passing through a bearing such that the bearing is pivotable relative to the pin generally about the axis of the pin; and a flexible portion for providing compliance between the handle and the connector part, the flexible portion being arranged to resist the pivoting of the bearing relative to the pin, wherein the bearing is configured to allow pivoting of the pin relative to the bearing generally about the axis of the connector part.

7. Apparatus for use at an end of a cable in an underwater or severe environment, comprising:

a connector part for connection with the cable, said connector part being adapted to be brought axially into engagement with another connector part and comprising a laterally directed:fitting for connecting the cable thereto;

a handle secured to the connector part at a location rearwardly of the fitting, said handle comprising a bearing, wherein said handle is secured to said connector part by securing means comprising a pin passing through the bearing such that the bearing is pivotable relative to the pin generally about the axis of the pin; and a flexible portion for providing compliance between the handle and the connector part, the flexible portion being arranged to resist movement of the bearing relative to the pin, wherein the passage of the pin through the bearing is such as to allow relative axial movement of the pin and the bearing.

8. Apparatus for use at an end of a cable in an underwater or severe environment, comprising:

a connector part for connection with the cable, said connector part being adapted to be brought axially into engagement with another connector part and comprising a laterally directed fitting for connecting the cable thereto;

a handle secured to the connector part at a location rearwardly of the fitting, wherein said handle is secured to said connector part by a pin passing through a bearing such that the bearing is pivotable relative to the pin generally about the axis of the pin; and a flexible portion for providing compliance between the handle and the connector part, the flexible portion being arranged to resist movement of the bearing relative to the pin, wherein the pin is mounted by a pin support and wherein the flexible portion is interposed between an abutment fixed in relation to the pin and an abutment fixed in relation to the bearing.

9. Apparatus for use at an end of a cable in an underwater or severe environment, comprising:

a connector part for connection with the cable, said connector part being adapted to be brought axially into engagement with another connector part and comprising a laterally directed fitting for connecting the cable thereto;

a handle secured to the connector part at a location rearwardly of the fitting, wherein said handle is secured to said connector part by securing means comprising a pin passing through a bearing such that the bearing is pivotable relative to the pin generally about the axis of the pin; and a flexible portion for providing compliance between the handle and the connector part, the flexible portion being arranged to resist the pivoting of the bearing about the axis of the pin, wherein the flexible portion is located rearwardly of the pin.

10. A subsea connector comprising first and second connector parts adapted to be brought axially into engagement with each other, the first connector part comprising:

a laterally directed fining for connecting the cable thereto;

a handle secured to the first connector part at a location rearwardly of the fining, wherein said handle is secured to said first connector part by a pin passing through a bearing such that the bearing is pivotable generally about the axis of the pin; and a flexible portion arranged to resist the pivoting of the bearing relative to the pin, wherein said flexible portion provides compliance between the handle and the connector part.

* * * * *

UNITED STATES PATENT AND TRADEMARK OFFICE

CERTIFICATE OF CORRECTION

PATENT NO. : 6,554,636 B2
DATED : April 29, 2003
INVENTOR(S) : Walker et al.

It is certified that error appears in the above-identified patent and that said Letters Patent is hereby corrected as shown below:

Column 5,
Line 45, delete “fining” and replace with -- fitting --.

Column 8,
Lines 14 and 16, delete “fining” and replace with -- fitting --.

Signed and Sealed this

Thirteenth Day of July, 2004

JON W. DUDAS
*Acting Director of the United States Patent and Trademark Office*